US006543732B1

(12) United States Patent
Yuan

(10) Patent No.: US 6,543,732 B1
(45) Date of Patent: Apr. 8, 2003

(54) MULTI-FUNCTIONAL RACK

(76) Inventor: Shih-Hwa Yuan, No. 4, Yung Chih St., Ying Ko Chen, Taipei Hsien (TW)

( * ) Notice: Subject to any disclaimer, the term of this patent is extended or adjusted under 35 U.S.C. 154(b) by 0 days.

(21) Appl. No.: 10/123,408

(22) Filed: Apr. 17, 2002

(51) Int. Cl.[7] ..... B65B 67/04

(52) U.S. Cl. ..... 248/99; 248/95; 248/97; 248/101; 248/166

(58) Field of Search ..... 248/95, 97, 99, 248/100, 101, 528, 166, 167, 188.6; 403/344, 289, 290, 102, 101, 103

(56) References Cited

U.S. PATENT DOCUMENTS

| | | | | | |
|---|---|---|---|---|---|
| 228,733 | A | * | 6/1880 | Curtis | 248/98 |
| 1,542,164 | A | * | 6/1925 | Nelson | 248/166 |
| 1,638,203 | A | * | 8/1927 | Jetel | 248/98 |
| 2,504,572 | A | * | 4/1950 | Nygard | 248/97 |
| 2,655,335 | A | * | 10/1953 | Johnson | 248/166 |
| 2,699,348 | A | * | 1/1955 | Fulop | 287/54 |
| 3,638,888 | A | * | 2/1972 | Ross | 248/153 |
| 3,754,771 | A | * | 8/1973 | Shagoury | 248/98 |
| 3,773,286 | A | * | 11/1973 | Govoni et al. | 248/150 |
| 4,160,557 | A | * | 7/1979 | Taylor | 248/98 |
| 4,202,521 | A | * | 5/1980 | Harding | 248/98 |
| 4,285,489 | A | * | 8/1981 | Blanchard | 248/166 |
| 4,576,350 | A | * | 3/1986 | Bond | 248/100 |
| 4,695,022 | A | * | 9/1987 | Mendonsa et al. | 206/314 |
| 4,708,307 | A | * | 11/1987 | Daigle | 248/95 |
| 5,183,226 | A | * | 2/1993 | Brooks | 248/97 |
| 5,209,517 | A | * | 5/1993 | Shagoury | 220/324 |
| 5,377,941 | A | * | 1/1995 | Har et al. | 248/101 |
| 5,738,315 | A | * | 4/1998 | Kent, Jr. | 248/156 |
| 5,826,838 | A | * | 10/1998 | Forbes | 248/95 |
| 5,899,419 | A | * | 5/1999 | Ross et al. | 248/97 |
| 6,092,767 | A | * | 7/2000 | Schrager | 248/95 |

* cited by examiner

*Primary Examiner*—Anita King
*Assistant Examiner*—Amy J. Sterling
(74) *Attorney, Agent, or Firm*—Rosenberg, Klein & Lee

(57) ABSTRACT

A rack includes a base, a supporting rod, and a hanging member. The base has opposing connecting parts on two opposing ends. The middle portions of the connecting parts define an upright cylindrical holding space in between. The supporting rod is passed into the upright holding space, and pivoted to the connecting parts at a lower end so that the supporting rod can be pivoted between a laid down position and an upright in-use position. The hanging member includes a ring-shaped supporting part pivoted to the top of the supporting rod such that it can be disposed perpendicular to the supporting rod for a bag to be hung on. The supporting rod is provided like a telescope so that the height of the hanging member can be changed to be suitable for bags of different sizes.

2 Claims, 6 Drawing Sheets

MULTI-FUNCTIONAL RACK

BACKGROUND OF THE INVENTION

The present invention relates to a multi-functional rack, more particularly one, which is used for holding a bag on, and is foldable, adjustable in size, and relatively uncomplicated in structure.

Bins are used most as containers for putting waste or dirty clothes in. Such bins are usually made of rattan, plastic or metal, and are formed with an annular wall and a bottom that don't have any hole on them. Thus, waste or dirty clothing can be put in a bag disposed in the inner space of the bin.

However, it is found that the conventional bin has disadvantages as followings:

1. The bin is formed with an annular wall that has no hole thereon, therefore the design is not ideal from the view point of economize the use of material.
2. The bin can't be collapsed into a smaller size for easy storage and transportation when it is not used.
3. Being not foldable, the bin occupies relatively large space in transportation, therefore the cost of transportation become a burden of the manufacturers.
4. The bin can't be changed in size to make it suitable for different purposes, therefore the users have to buy bins of different sizes.

SUMMARY OF THE INVENTION

Therefore, it is a main object of the present invention to provide a bin substituting rack which is used for holding a bag on, and which is foldable, adjustable in height, and allows the use of material to be economized.

The rack of the present invention includes a base, a supporting rod, and a hanging member. The base is made of a folded tube having opposing connecting parts on two opposing ends; the middle portions of the connecting parts define an upright cylindrical holding space in between. The supporting rod is passed into the upright holding space, and pivoted thereto at a lower end. Thus, the supporting rod can be pivoted between a laid down position and an upright in-use position. The hanging member includes a ring-shaped supporting part, which is pivoted to the top of the supporting rod, and can be disposed perpendicular to the supporting rod for a bag to be hung on. The supporting rod is provided with an upper, and a lower parts connected in such a way that it is adjustable in length like a telescope.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
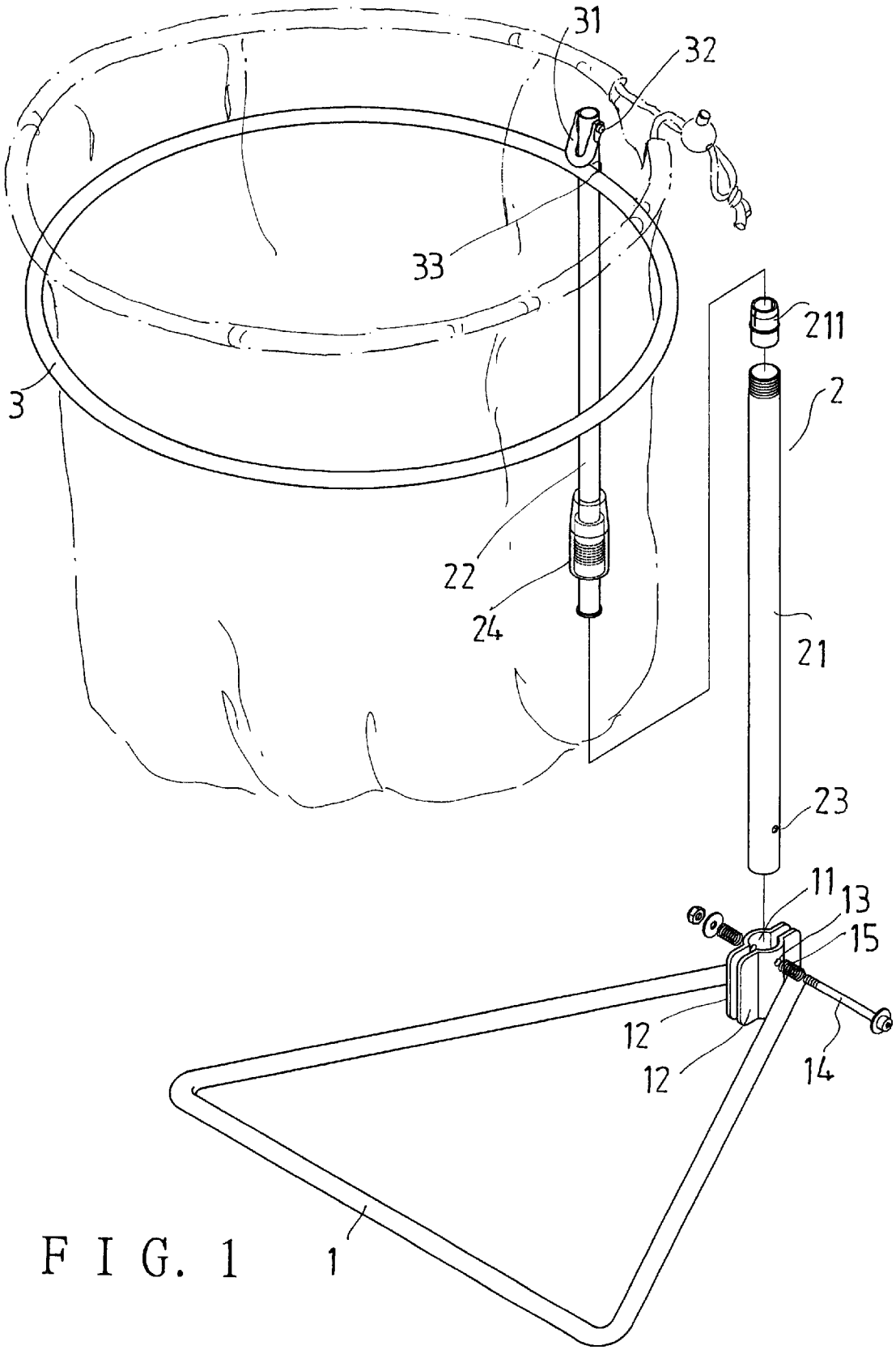
FIG. 1 is an exploded perspective view of the rack of the present invention.
Figure 2:
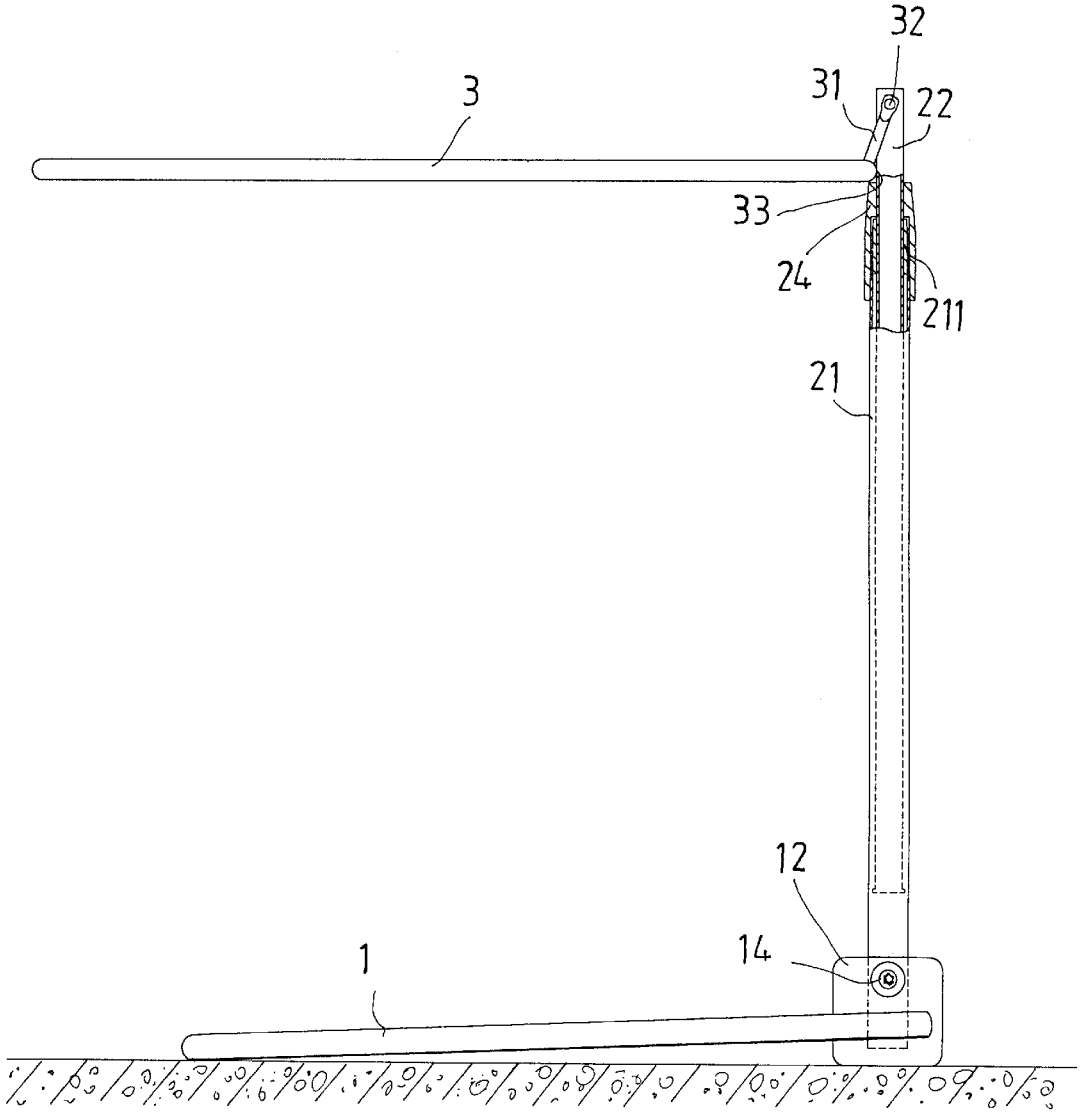
FIG. 2 is a side view of the rack of the present invention.
Figure 3:
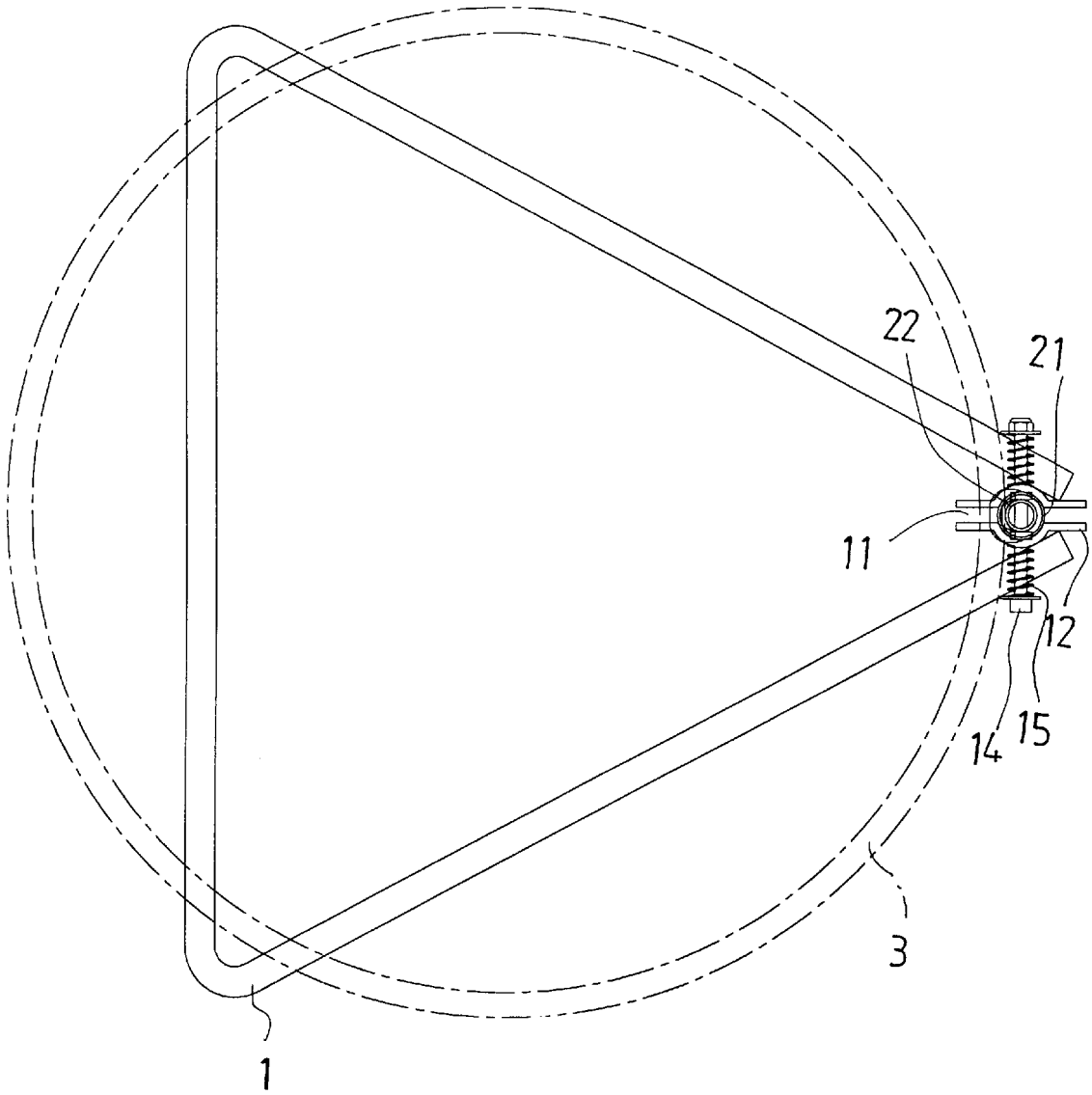
FIG. 3 is a bottom view of the rack of the present invention.
Figure 4:
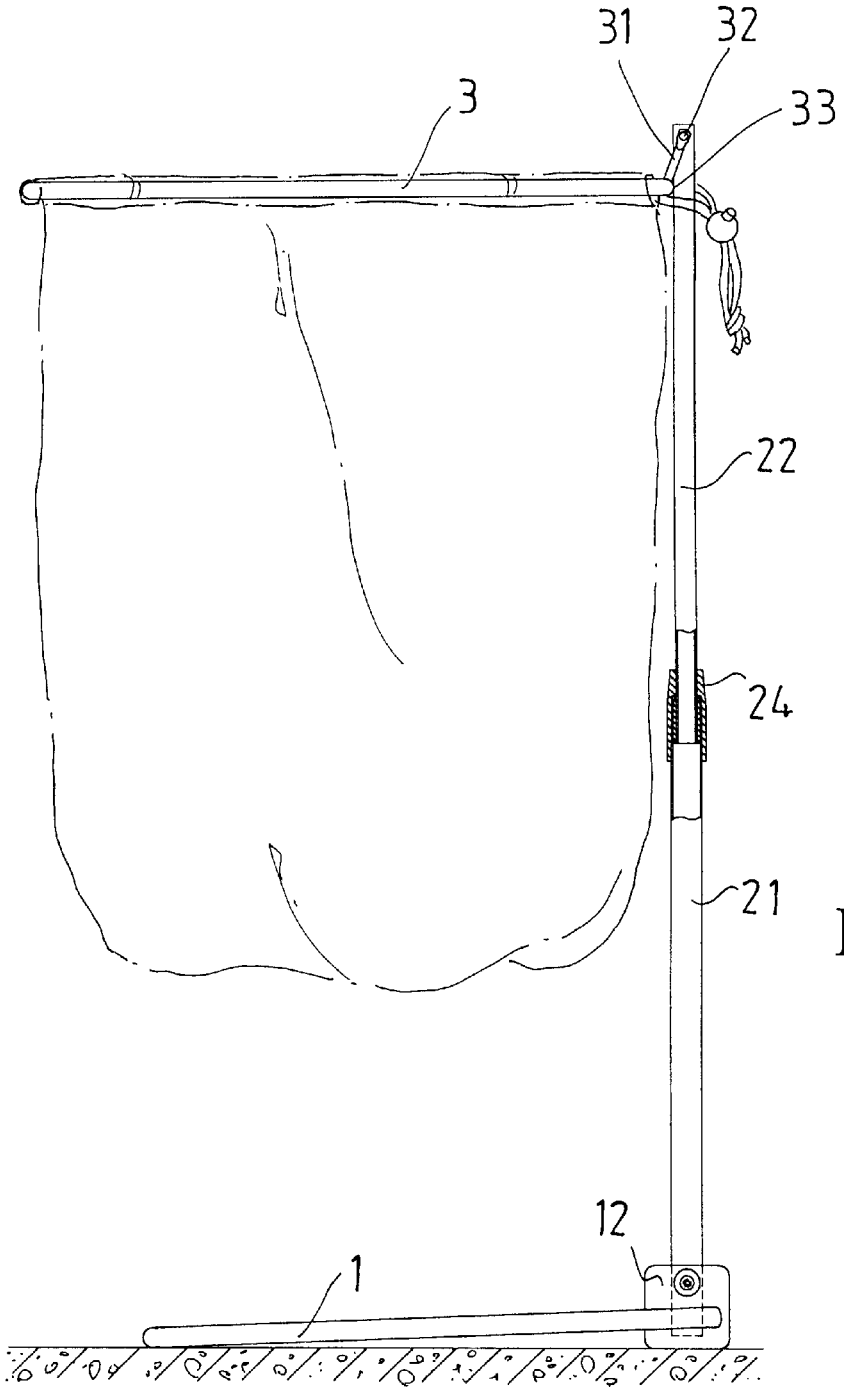
FIG. 4 is a side view of the rack of the present invention with a bag hung thereon.
Figure 5:
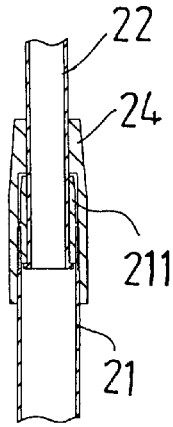
FIG. 5 is a fragmentary view of the rack of the present invention.
Figure 6:
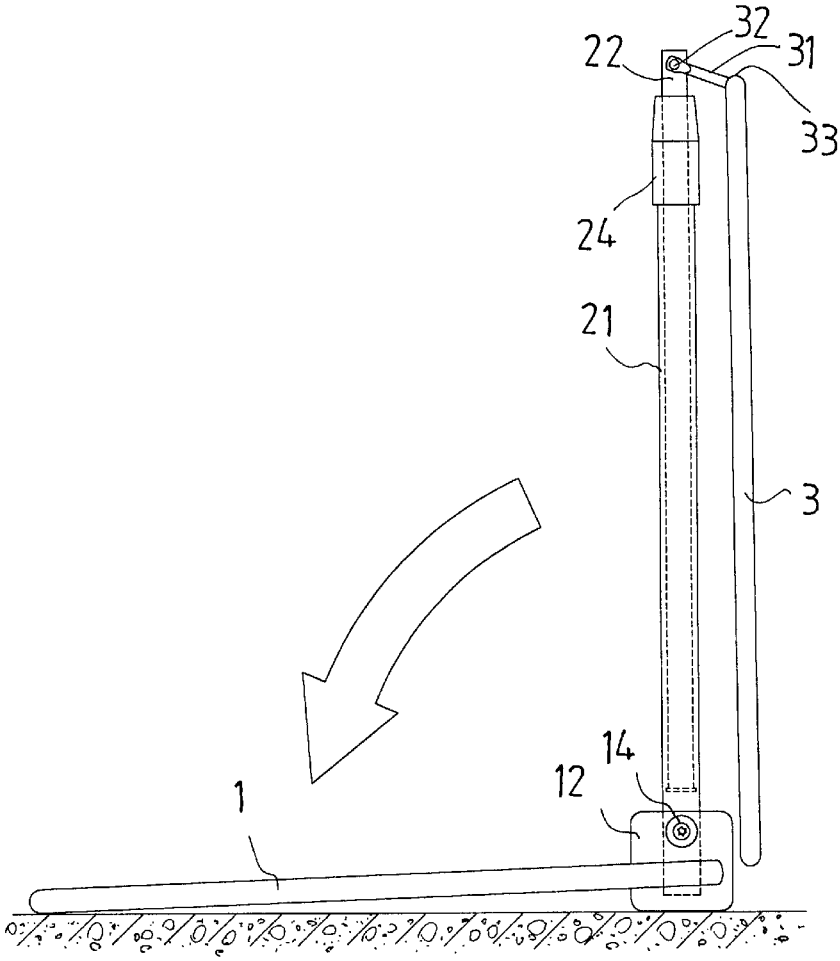
FIG. 6 is a side view of the rack of the present invention in partially folded position.
Figure 8:
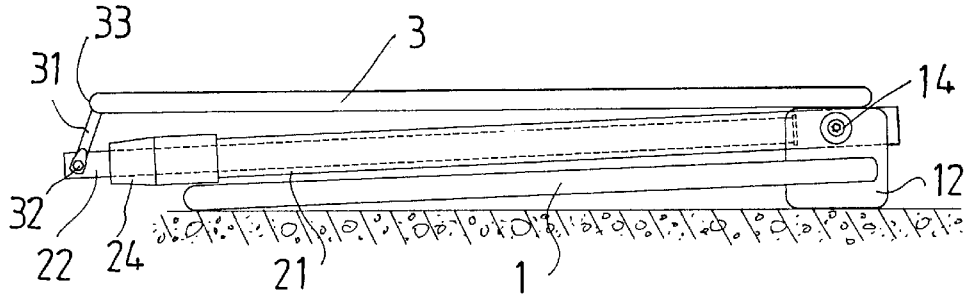
FIG. 8 a side view of the rack of the present invention in completely folded position.
Figure 7:
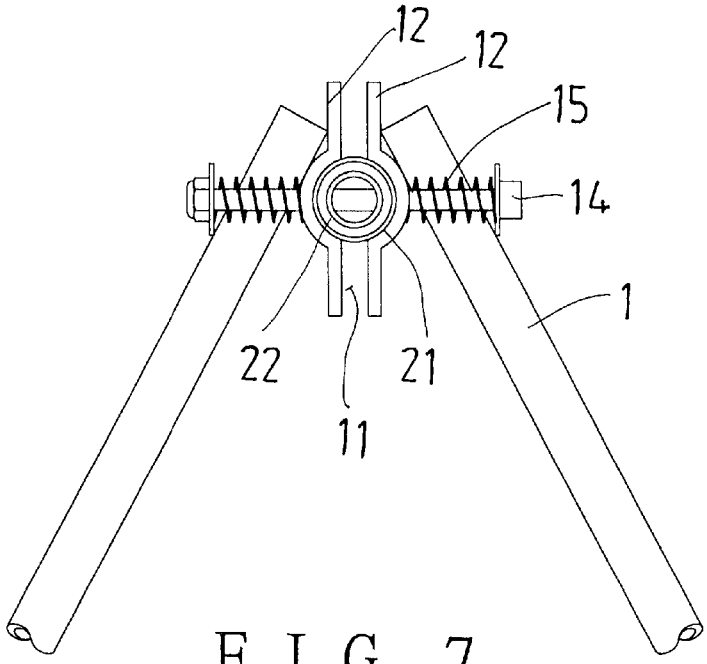
FIG. 7 a partial bottom view of the rack of the present invention.
Figure 9:
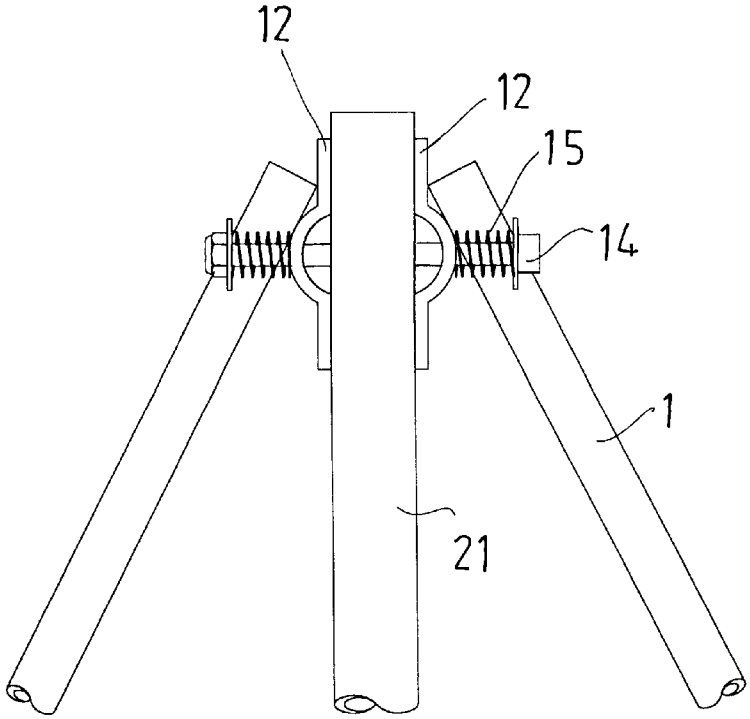
FIG. 9 a partial bottom view of the rack of the present invention in folded position.

Referring to FIG. 1, a multifunctional rack of the present invention includes a base 1, a supporting rod 2, and a hanging member 3.

The base 1 is made of a folded tube, which is shaped so that it has two opposing ends, and is provided with a connecting part 12 at each of the opposing end; the connecting parts 12 are outwardly curved in middle portions as to define an upright cylindrical holding space 11 in between; a front, and a rear ends of the connecting parts 12 can be formed with flat portions. The curved portions of the connecting parts 12 have opposing through holes 13.

The supporting rod 2 is held between the connecting parts 12 of the base 1 at a lower portion. The supporting rod 2 has a through hole 23 at the lower portion. A bolt 14 is passed through the through holes 13 of the connecting parts 12, and the through hole 23 of the supporting rod 2 for allowing the supporting rod 2 to be pivoted thereon. Elastic elements 15 are disposed on outer sides of the curved portions for the bolt 14 to pass through so as to allow the supporting rod 14 to be pivoted to a laid down position where the connecting parts 12 are moved further away from each other; the diameter of the rod 2 is bigger than the distance between the flat portions of the connecting parts 12 having not been moved further away from each other.

Furthermore, the supporting rod 2 can be made of a hollow lower part 21, a connecting tube 24, and an upper part 22. The upper part 22 is passed through a contracting member 211 disposed at the top of the lower part 21, and is also passed into the hollow lower part 21 from a lower end. The contracting member 211 can become narrower under external force. The lower part 21 has threads on an upper end portion thereof. The connecting tube 24 has threads on an inner side thereof, and is turnably passed around the upper part 22 so that the same can be screwed onto the upper threaded end of the hollow lower part 21 to make the contracting member 211 contract to clip the upper part 22 in position. Therefore, the supporting rod 2 is adjustable in length.

The hanging member 3 includes a ring-shaped supporting part, and a connecting part 31 secured to the ring-shaped part. The connecting part 31 of the hanging member 3 is pivoted to an upper end of the supporting rod 2 by means of a pivotal bolt 32 so that the ring-shaped part can be disposed in a stretched position, and a folded position; in the stretched position, the ring-shaped part is perpendicular to the supporting rod 2 disposed in the upright position, while in the folded position, the same is parallel to the supporting rod 2 in the laid-down position. When the rack is stretched, a bag can be hung on the hanging member 3 from the opening of the bag for putting objects in.

From the above description, it can be easily understood that the rack of the present invention has advantages as followings:

1. The use of material for the rack is relatively economized as compared with that of a conventional bin used for holding a bag in.
2. The main parts of the rack are in pivotal connection so that the rack can be easily folded into smaller size when not used.
3. The rack can be folded into a smaller size to allow the cost of transportation and storage to be reduced for the manufacturers.

4. The rack is adjustable in height to be suitable for bags of different sizes.

What is claimed is:

1. A rack, comprising:

a base, the base being made of a folded tube, the folded tube having two connecting parts respectively disposed on two opposing ends of said folded tube, the connecting parts being outwardly curved in middle portions thereof to define an upright cylindrical holding space therebetween, the curved portions having aligned through holes formed therein;

a supporting rod, the supporting rod having a lower portion being releasably held between the connecting parts of the base, a bolt being passed through the through holes of the connecting parts and a through hole of the lower portion of the supporting rod for allowing the supporting rod to be pivoted thereon, a pair of elastic elements being respectively disposed on the bolt at outer sides of the curved portions of the connecting parts to apply a bias force to the connecting parts for capturing the lower portion of the supporting rod within the holding space and for allowing the supporting rod to be pivoted to a laid down position where the connecting parts are moved further away from each other against the bias force of the elastic elements;

a hanging member, the hanging member including a ring-shaped supporting part, and a connecting member secured to the ring-shaped part, the connecting member being pivotally coupled to an upper end of the supporting rod and the supporting part of the hanging member acting as a stop against the supporting rod to position the supporting part to extend over the base in substantially orthogonal relationship with the supporting rod, the hanging member being pivotally displaceable over the upper end of the supporting rod to position the supporting part in substantially parallel relationship with the supporting rod;

whereby a bag is hung from the supporting part of the hanging member.

2. The rack of claim 1, wherein the supporting rod consists of a hollow lower part, a connecting tube, and an upper part; the upper part being passed through a contracting member, and into the hollow lower part from a lower end; the connecting tube being turnably passed around the upper part; the connecting tube being able to be screwed onto an upper end of the hollow lower part to make the contracting member contract to clip the upper part in position.

* * * * *